US009434589B1

(12) United States Patent
Wilson

(10) Patent No.: US 9,434,589 B1
(45) Date of Patent: Sep. 6, 2016

(54) PAINT CAN LIP REMOVER

(71) Applicant: Robert T. Wilson, Valrico, FL (US)

(72) Inventor: Robert T. Wilson, Valrico, FL (US)

( * ) Notice: Subject to any disclaimer, the term of this patent is extended or adjusted under 35 U.S.C. 154(b) by 254 days.

(21) Appl. No.: 14/263,449

(22) Filed: Apr. 28, 2014

(51) Int. Cl.
*B67B 7/14* (2006.01)

(52) U.S. Cl.
CPC ..... *B67B 7/14* (2013.01)

(58) Field of Classification Search
CPC ..... B67B 7/14; B67B 7/16
USPC ..... 81/3.37; 7/151
See application file for complete search history.

(56) References Cited

U.S. PATENT DOCUMENTS 373,528 A * 11/1887 Judd ..... B67B 7/0441 254/123
572,435 A * 12/1896 Meyerholz ..... B65D 39/04 217/110
5,295,419 A * 3/1994 Denning ..... B67B 7/14 81/3.37
5,634,484 A * 6/1997 Vodila ..... B67B 7/42 137/15.08
6,393,947 B1 * 5/2002 Corcoran ..... B67B 7/18 81/3.31

* cited by examiner

*Primary Examiner* — Hadi Shakeri
(74) *Attorney, Agent, or Firm* — Edward P. Dutkiewicz

(57) ABSTRACT

A paint can lip remover comprises a base, having a generally disc-like configuration, an upright member being coupled to the base, and a handle having a holding end and a working end having a pry hook.

7 Claims, 4 Drawing Sheets

FIG. 3
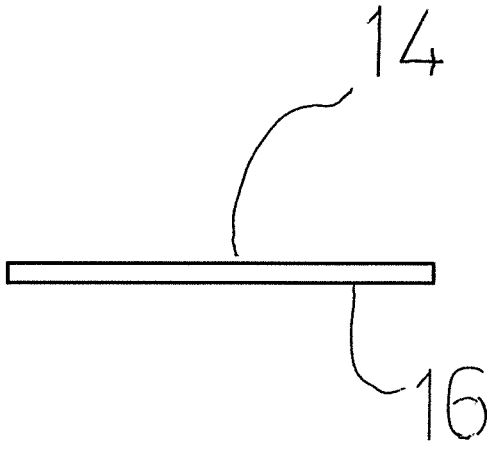
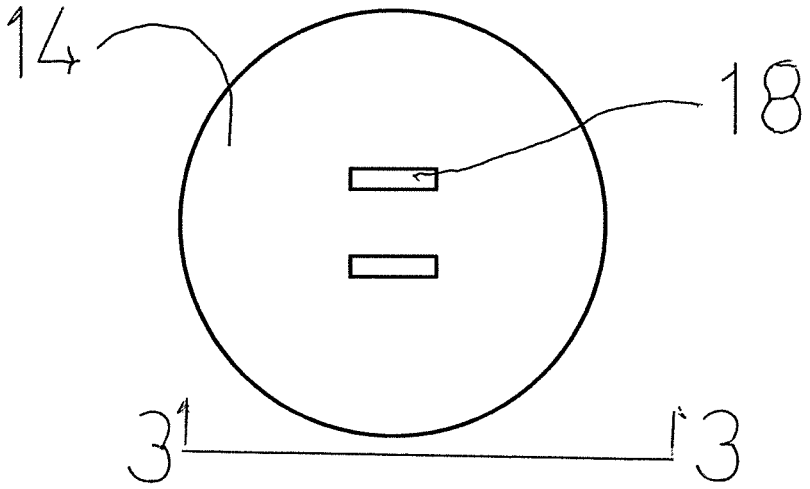
FIG. 2

PAINT CAN LIP REMOVER

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a paint can lip remover and more particularly pertains to a device to remove the lip from a paint can.

DESCRIPTION OF THE PRIOR ART

The use of devices to remove a paint can lip is known in the prior art. More specifically, devices to remove a paint can lip previously devised and utilized for the purpose of removing a pint can lip are known to consist basically of familiar, expected, and obvious structural configurations, notwithstanding the designs encompassed by the prior art which has been developed for the fulfillment of stated objectives and requirements.

While the prior art devices fulfill their respective, particular objectives and requirements, the prior art does not describe paint can lip remover that allows a device to remove the lip from a paint can in a safe and convenient manner.

In this respect, the paint can lip remover, according to the present invention, substantially departs from the conventional concepts and designs of the prior art, and in doing so provides an apparatus primarily developed for the purpose of a device to remove the lip from a paint can.

Therefore, it can be appreciated that there exists a continuing need for a new and improved paint can lip remover which can be used to remove the lip from a paint can. In this regard, the present invention substantially fulfills this need.

SUMMARY OF THE INVENTION

In view of the foregoing disadvantages inherent in the known types of devices to remove a paint can lip now present in the prior art, the present invention provides an improved paint can lip remover. As such, the general purpose of the present invention, which will be described subsequently in greater detail, is to provide a new and improved paint can lip remover which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain the objectives, the present invention essentially comprising a paint can lip remover is herein described. The paint can lip remover comprises several components, in combination.

There is a base. The base is fabricated of a rigid material. The base has a generally disc-like configuration, having an upper surface and a lower surface, with a thickness there between. The base has a pair of slots there through. The base slots each have a first length.

There is an upright member. The upright member is fabricated of a rigid material. The upright member has a generally elongated inverted U-shaped configuration with a left leg, a right leg, and a crossover top piece. The left leg of the upright member and the right leg of the upright member and cross over top piece of the upright member each have an inner surface and an outer surface. The upright member has a first distance between the outer surface of the left leg and the outer surface of the right leg. The upright member has a first width. The upright member has a lower open end and a closed upper end, with a second length there between. The open lower end of the upright member has a pair of end tabs. The end tabs of the upright member each have a second width. The second width being less than the first width. The second width being less than the first length of the base slots, allowing the tabs to be inserted into the base slots for securement of the base to the upright member.

The upright member has a plurality of cross pin holes there through, with each cross pin hole having an associated cross pin. Each cross pin has a third length. In the preferred embodiment each cross pin is pressed into the cross pin holes. The third length being greater than the first distance between the outer surface of the right leg and the outer surface of the left leg of the upright member.

In a variation, the cross pin has a solid end and a hollow tubular end. Each upright member cross pin has a first external diameter. The hollow tubular end of each cross pin protrudes from the outer surface of the left leg. The hollow tubular end of each cross pin has an internal thread of a first internal diameter (not shown). Each hollow tubular end of each cross pin has an associated screw (not shown), with the cross pin screw being threadedly received by the hollow tubular end of each cross pin. Each cross pin screw has a head (not shown) with the screw head having a second external diameter. The second external diameter is greater than the first external diameter of the cross pin.

There is a handle. The handle is fabricated of a rigid material. The handle has a holding end having a first thickness and a working end having both the first thickness and a second thickness, with a step there between. The handle has a length between the holding end and the working end. The handle has a left surface and a right surface, with a thickness there between. The thickness of the handle forms a peripheral edge of the handle. The holding end of the handle has a generally rounded terminus. The length of the handle has a pair of holed slots. The working end of the handle has an end portion and a connecting portion.

The connecting portion of the working end of the handle is continuous with the length of the handle. The connecting portion of the working end of the handle has a pair of angled recesses therein. The recesses of the connecting portion of the working end of the handle are formed in the peripheral edge of the handle connecting portion, with the angle of the angled recesses being toward the holding end of the handle. The angle of each of the recesses is between about twenty five degrees and ninety degrees relative to the peripheral edge of the length. The working end of the handle has a pry hook with a generally rounded terminus. The pry hook has a receiving surface which is oriented in a direction generally opposite from the direction of the recesses of the peripheral edge of the connecting portion of the working end of the handle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint can lip remover which has all of the advantages of the prior art devices, with which to remove a paint can lip, and none of the disadvantages.

It is another object of the present invention to provide a new and improved paint can lip remover which may be easily and efficiently manufactured and marketed.

It is further object of the present invention to provide a new and improved paint can lip remover which is of durable and reliable constructions.

An even further object of the present invention is to provide a new and improved paint can lip remover which is susceptible of a low cost of manufacture with regard to both materials and labor, and which accordingly is then susceptible of low prices of sale to the consuming public, thereby making such paint can lip remover economically available to the buying public.

Even still another object of the present invention is to provide a paint can lip remover for allowing a user to easily and efficiently remove the lip from a paint can.

Lastly, it is an object of the present invention to provide a new and improved paint can lip remover comprises a base, having a generally disc-like configuration, an upright member being coupled to the base, and a handle having a holding end and a working end having a pry hook.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top plan view of the base, showing the slots therein.

FIG. 3 is a view along line 3-3 of FIG. 2, showing the thickness of the base, with the upper surface and the lower surface.

The same reference numerals refer to the same parts throughout the various Figures.

DESCRIPTION OF THE PREFERRED EMBODIMENT

Figure 1:
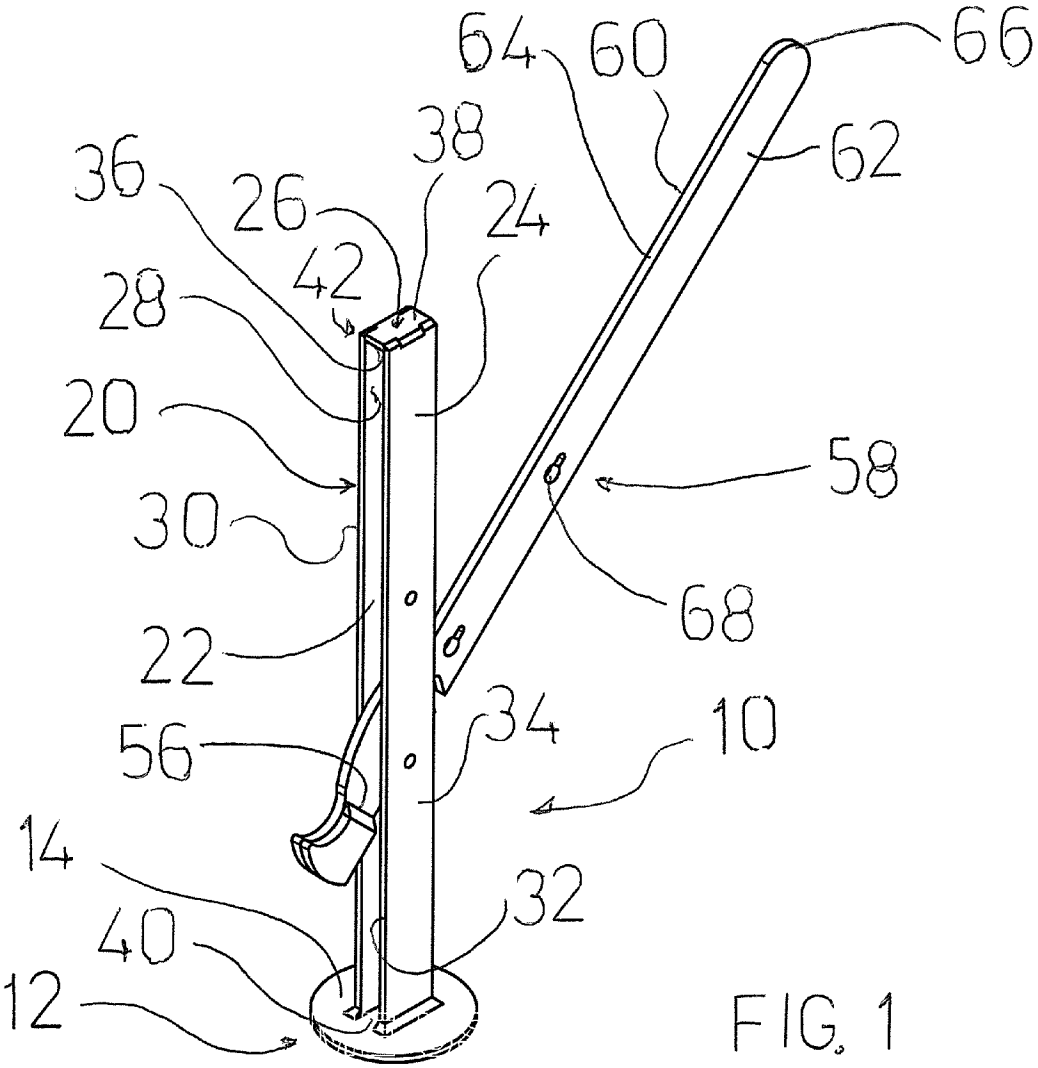
FIG. 1 is perspective view of the assembled lip remover viewed from the right side of the device.
Figure 4:
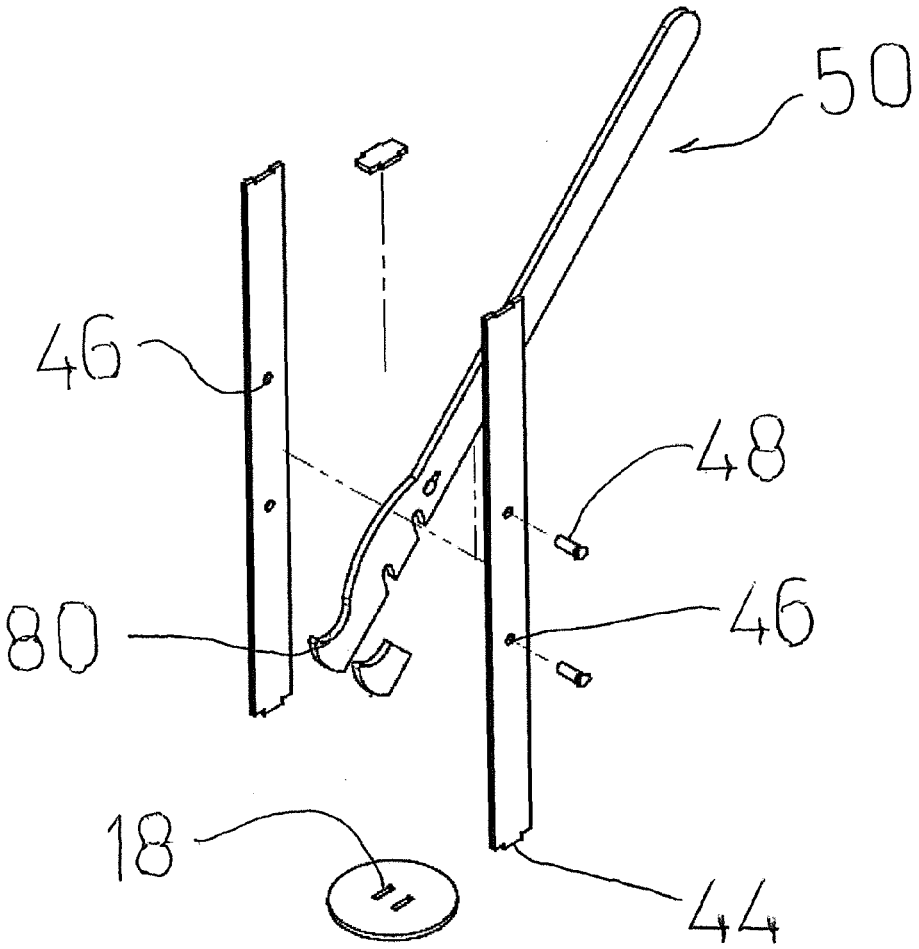
FIG. 4 is an exploded view of the lip remover. Note the hook end of the handle. There is a double thickness, lending strength to the working end. The double thickness forms a step on the surface of the handle.
Figures 5, 6, 7, 8:
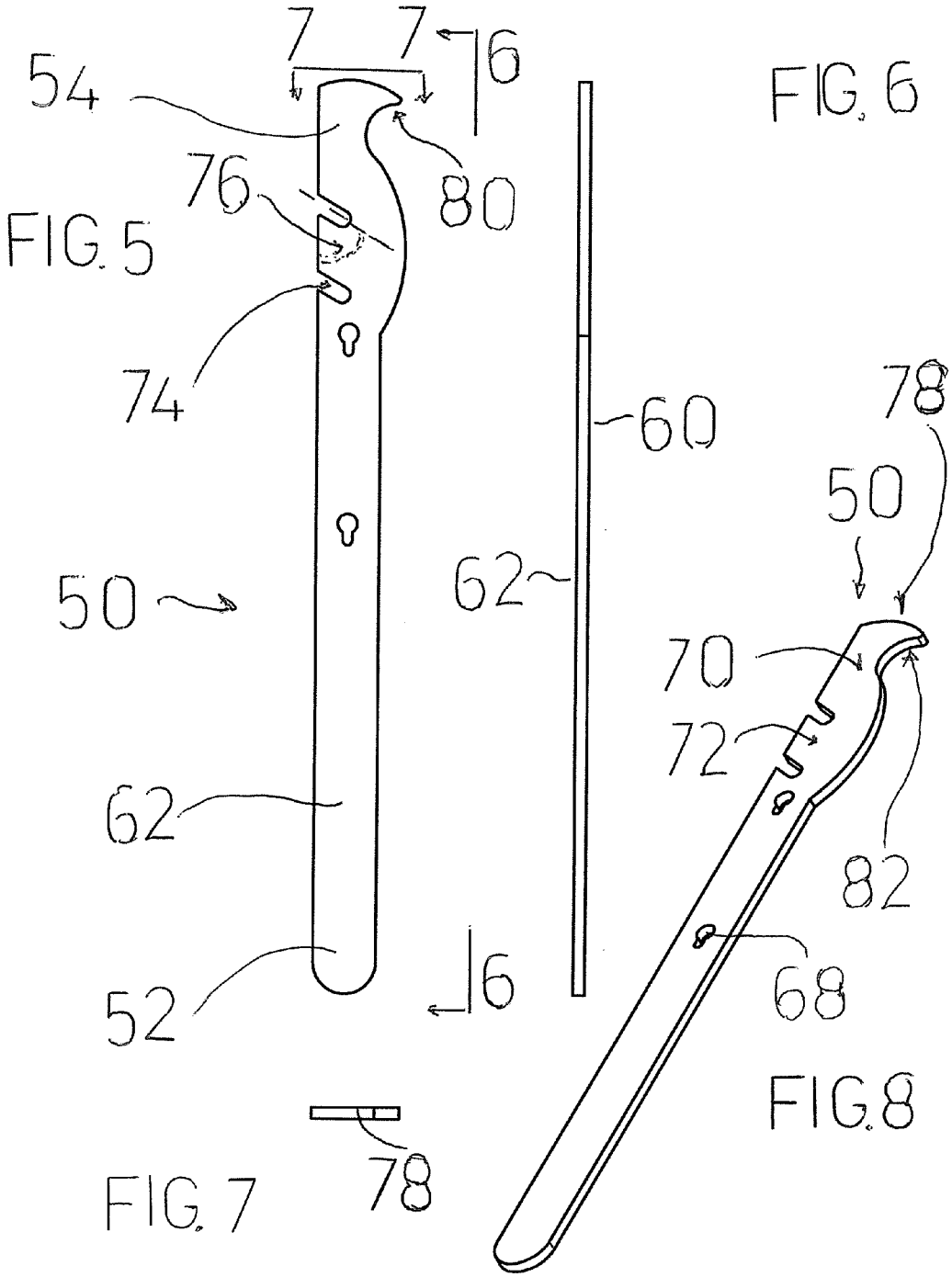
FIG. 5 is a side elevational view of the handle.
FIG. 6 is a view taken along line 6-6 of FIG. 5, showing the length and the thickness of the handle.
FIG. 7 is a view taken along line 7-7 of FIG. 5, showing the end view of the working end.
FIG. 8 is a perspective view of the handle.

With reference now to the drawings, and in particular to FIG. 1 thereof, the preferred embodiment of the new and improved paint can lip remover embodying the principles and concepts of the present invention and generally designated by the reference numeral 10 will be described.

The present invention, the paint can lip remover 10 is comprised of a plurality of components. Such components in their broadest context include a base, an upright member, and a handle. Such components are individually configured and correlated with respect to each other so as to attain the desired objective.

A paint can lip remover 10 is described. The paint can lip remover comprises several components, in combination.

There is a base 12. The base is fabricated of a rigid material. The base has a generally disc-like configuration, having an upper surface 14 and a lower surface 16, with a thickness there between. The base has a pair of slots 18 there through. The base slots each have a first length.

There is an upright member 20. The upright member is fabricated of a rigid material. The upright member has a generally elongated inverted U-shaped configuration with a left leg 22, a right leg 24, and a crossover top piece 26. The left leg of the upright member has an inner surface 28 and an outer surface 30. The right leg of the upright member has an inner surface 32 and an outer surface 34, and the cross over top piece of the upright member has an inner surface 36 and an outer surface 38. The upright member has a first distance between the outer surface of the left leg and the outer surface of the right leg. The upright member has a first width. The upright member has a lower open end 40 and a closed upper end 42, with a second length there between. The open lower end of the upright member has a pair of end tabs 44. The end tabs of the upright member each have a second width. The second width being less than the first width. The second width being less than the first length of the base slots, allowing the tabs to be inserted into the base slots for securement of the base to the upright member.

The upright member has a plurality of cross pin holes 46 there through, with each cross pin hole having an associated cross pin 48. Each cross pin has a third length. In the preferred embodiment each cross pin is pressed into the cross pin holes. The third length being greater than the first distance between the outer surface of the right leg and the outer surface of the left leg of the upright member.

In a variation, the cross pin has a solid end and a hollow tubular end. Each upright member cross pin has a first external diameter. The hollow tubular end of each cross pin protrudes from the outer surface of the left leg. The hollow tubular end of each cross pin has an internal thread of a first internal diameter (not shown). Each hollow tubular end of each cross pin has an associated screw (not shown), with the cross pin screw being threadedly received by the hollow tubular end of each cross pin. Each cross pin screw has a head (not shown) with the screw head having a second external diameter. The second external diameter is greater than the first external diameter of the cross pin.

There is a handle 50. The handle is fabricated of a rigid material. The handle has a holding end 52 having a first thickness and a working end 54 having both the first thickness and a second thickness, with a step 56 there between. The handle has a length 58 between the holding end and the working end. The handle has a left surface 60 and a right surface 62, with a thickness there between. The thickness of the handle forms a peripheral edge 64 of the handle. The holding end of the handle has a generally rounded terminus 66. The length of the handle has a pair of holed slots 68. The working end of the handle has an end portion 70 and a connecting portion 72.

The connecting portion of the working end of the handle is continuous with the length of the handle. The connecting portion of the working end of the handle has a pair of angled recesses 74 therein. The recesses of the connecting portion of the working end of the handle are formed in the peripheral edge of the handle connecting portion, with the angle 76 of the angled recesses being toward the holding end of the handle. The angle of each of the recesses is between about twenty five degrees and ninety degrees relative to the peripheral edge of the length. The working end of the handle has a generally rounded terminus 78. There is a pry hook 80. The pry hook has a receiving surface 82 which is oriented in a direction generally opposite from the direction of the recesses of the peripheral edge of the connecting portion of the working end of the handle.

The components of the paint can lip remover may be supplied with a lip retainer and a paint roller grate which are not shown. The lip retainer is fabricated of a rigid material. The lip retainer has a generally ovoid configuration.

The paint roller grate has an upper end having a pair of paint can lip hooks and a lower end with a standoff, with a grate section there between.

In use the lip remover is inserted into an existing paint can having a bottom and an upper lip. The base of the lip remover is placed against the bottom of the paint can and the handle is adjusted, using the recesses, to position the pry hook to the lip of the existing paint can. The handle is then moved to pry the lip of the paint can upward, and off of the can. The lip retainer is then slipped onto the upper end of the paint can, where the lip was removed. The oval form of the lip retainer maintains the paint can in an oval configuration. The grate is then inserted into the paint can. The width of the oval allows a roller to be placed into the can, so as to acquire the paint onto the roller. The grate is used to remove excess paint from the roller.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint can lip remover comprising, in combination:

a base having a generally disc-like configuration having an upper surface and a lower surface with a thickness there between;

an upright member being coupled to the base;

a handle having a holding end with a first thickness;

the upright member having a generally elongated inverted U shaped configuration with a left leg and a right leg and a crossover top piece;

a working end of the handle having an end portion and a connecting portion;

the handle having a length between the holding end and the working end, the handle having a left surface and a right surface with a thickness there between, the handle working end having the first thickness and a second thickness with a step there between;

the connecting portion of the working end of the handle being continuous with the length of the handle;

the base having a pair of slots there through;

the upright member left leg and the upright member right leg and upright member cross over top piece each having an inner surface and an outer surface;

the upright member having a first distance between the outer surface of the left leg and the outer surface of the right leg;

a thickness of the handle forming a peripheral edge of the handle;

the upright member having a first width;

the length of the handle having a pair of holed slots there through;

the upright member having a lower open end and a closed upper end with a second length there between;

the connecting portion of the working end of the handle having a pair of angled recesses therein;

the base slots having a first length;

the upright member open lower end having a pair of end tabs, the end tabs having a second width; and the recesses in the connecting portion of the working end of the handle being formed in the peripheral edge of the handle connecting portion with the angle of the angled recesses being toward the holding end of the handle.

2. The paint can lip remover as described in claim 1, with the paint can lip remover further comprising:

the second width of the upright member end tabs being less than the first width of the upright member; and the angle of each of the recesses of the connecting portion of the handle being between about twenty five degrees and ninety degrees relative to the peripheral edge of the length of the handle.

3. The paint can lip remover as described in claim 2, with the paint can lip remover further comprising:

the upright member second width being less than the first length of the base slots, allowing the tabs of the upright member to be inserted into the base slots for securement of the base to the upright member; and the working end of the handle having a pry hook with a generally rounded terminus.

4. The paint can lip remover as described in claim 3, with the paint can lip remover further comprising:

the upright member having a plurality of cross pin holes there through with each cross pin hole having an associated cross pin; and the pry hook having a receiving surface which is oriented in a direction generally opposite from the direction of the recesses of the peripheral edge of the connecting portion of the working end of the handle.

5. The paint can lip remover as described in claim 4, with the paint can lip remover further comprising:

each upright member cross pin having a third length with a solid end and a hollow tubular end, each upright member cross pin having a first external diameter, the third length being greater than the first distance between the outer surface of the right leg and the outer surface of the left leg; and the hollow tubular end of each upright member cross pin protruding from the outer surface of the left leg.

6. The paint can lip remover as described in claim 5, with the paint can lip remover further comprising:

the hollow tubular end of each upright member cross pin having a thread of a first internal diameter, each hollow tubular end of each upright member cross pin having an associated screw, with the cross pin screw being threadedly received by the hollow tubular end of each cross pin; and the handle holding end having a generally rounded terminus.

7. The paint can lip remover as described in claim 6, with the paint can lip remover further comprising each upright member cross pin screw having a head with the head having a second external diameter, the second external diameter being greater than the first external diameter of the cross pin.

* * * * *